United States Patent [19]

Heidmann et al.

[11] 4,397,430

[45] Aug. 9, 1983

[54] SIMPLIFIED HOMING SYSTEM FOR A MISSILE OF THE SHELL OR ROCKET TYPE

[75] Inventors: Richard Heidmann, Vernon; Dino Crapiz, Ecos, both of France

[73] Assignee: Societe Europeenne de Propulsion, Puteaux, France

[21] Appl. No.: 230,117

[22] Filed: Jan. 26, 1981

[30] Foreign Application Priority Data

Jan. 29, 1980 [FR] France ..... 80 01869

[51] Int. Cl.[3] ..... F41G 7/22

[52] U.S. Cl. ..... 244/3.16

[58] Field of Search ..... 244/3.15, 3.16, 3.19, 244/3.21; 5/451

[56] References Cited

U.S. PATENT DOCUMENTS

| | | | |
|---|---|---|---|
| 3,642,233 | 2/1972 | Bezerie | 244/3.16 |
| 3,706,429 | 12/1972 | Welford et al. | 244/3.19 |
| 3,735,944 | 3/1973 | Bannett et al. | 244/3.15 |
| 3,905,563 | 9/1975 | Nagoshi | 244/3.15 |
| 4,264,907 | 4/1981 | Durand, Jr. et al. | 244/3.15 |
| 4,318,515 | 3/1982 | Leek | 244/3.16 |

*Primary Examiner*—Charles T. Jordan

*Attorney, Agent, or Firm*—Wilson, Fraser, Barker & Clemens

[57] ABSTRACT

The simplified homing system comprises an accelerometric device mounted directly on the missile structure and associated with discriminating means for delivering signals representative of the lateral acceleration $\gamma_{ext}$ of the missle due to outside forces and the centrifugal acceleration $\gamma_c$ due to the rolling; target detection means directly mounted on the missile structure; passive means ensuring the keeping up of the rolling movement of the missile; means for determining from information supplied by the accelerometric device and discriminating means and by target detection means the serviceable values related to the vector $\vec{V}$ indicating the relative speed of the missile with respect to the air in a reference system related to the missile and to the vector $\vec{u_c}$ representing the direction of the target with respect to the axis of the missile and means for elaborating a guiding force $\vec{F_p}$ from the said predetermined serviceable values related to the vectors $\vec{V}$ and $\vec{u_c}$.

16 Claims, 12 Drawing Figures

Figure 1:
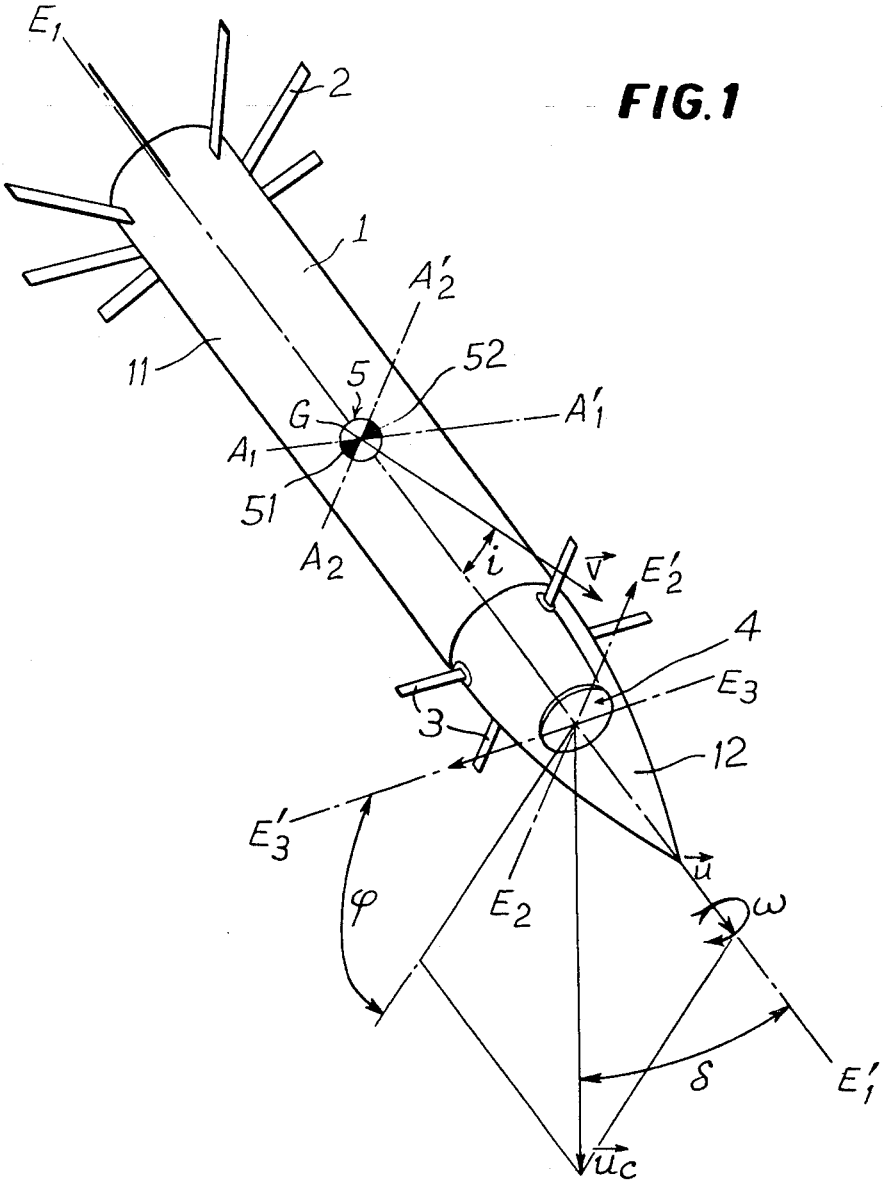

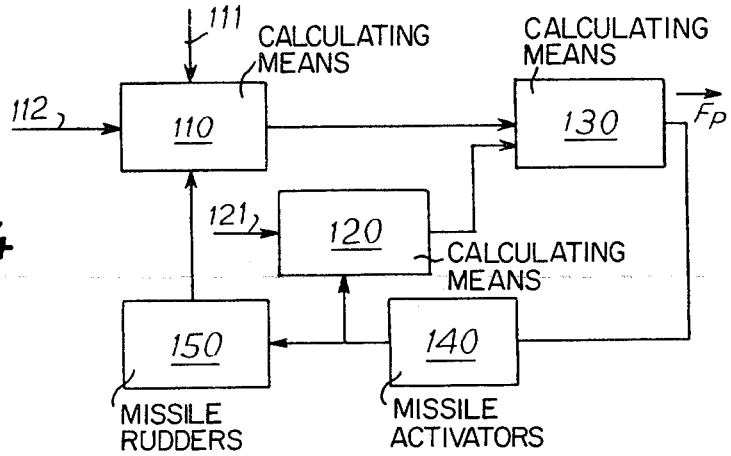
FIG. 4
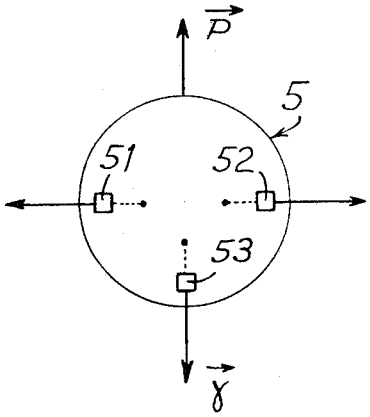
FIG. 5
FIG. 6
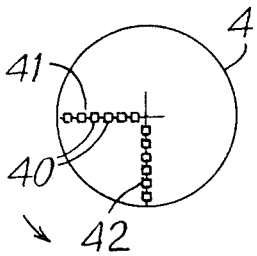
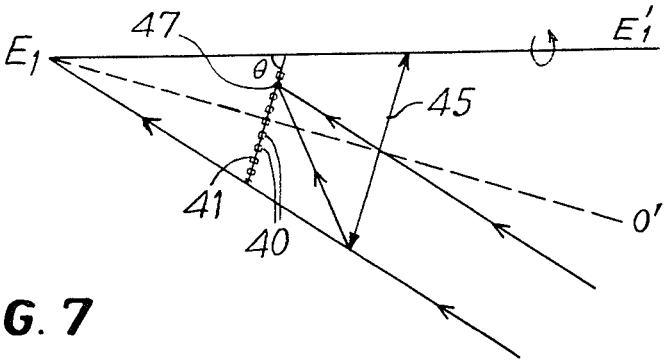
FIG. 7

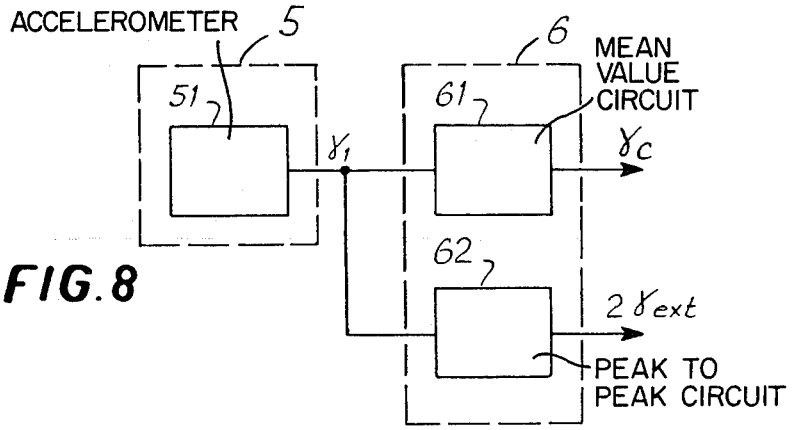
FIG. 8
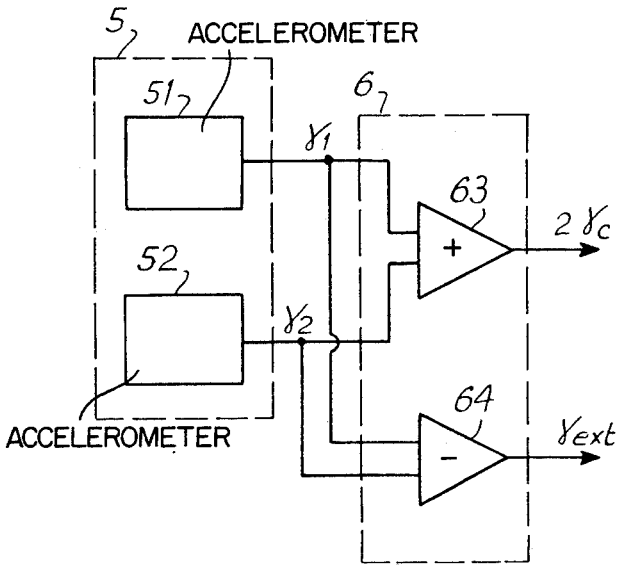
FIG. 9
FIG. 10
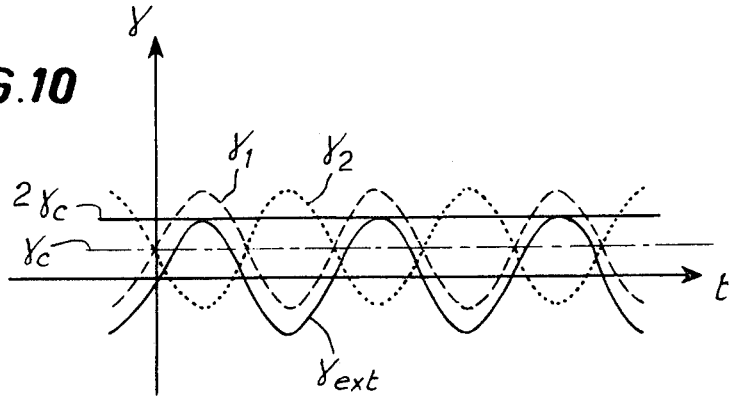

SIMPLIFIED HOMING SYSTEM FOR A MISSILE OF THE SHELL OR ROCKET TYPE

The present invention relates to a simplified homing system for a missile of the shell or rocket type not actively stabilized in attitude.

Systems of ground-to-ground artillery or air-to-ground weapons, based on shells or rockets call more and more on the use of self-propelled missiles provided with warheads which can comprise multiple subcharges. Said missiles constituted by these warheads, and designed to reach a predetermined target can be split into several categories. Said missiles so-called directed effect missiles, i.e. whose action is remotely controlled, without guidance, in the direction of a target as soon as the latter is detected, have the advantage of economizing on a guidance system, but their range and efficiency are limited due to the limited accuracy of the remote control. Guided missiles can be very accurate but they are relatively complex and expensive. Finally, missiles with end-of-run guidance by self-directing means, using for example a law of proportional guidance, can be accurate but they require active means of attitude stabilization of the missile and means for mounting the detection device on a gyro-system in order to have an open and inertial aerial capable of keeping the target in sight. Such systems can only re-group enough accuracy, both in target detection field and in likelihood of reach, at the cost of a transformation of the ammunitions to which they are applied into sophisticated and expensive missiles.

It is precisely the object of the present invention to produce a simplified guidance equipment permitting to eliminate the inaccuracies and range limitations of the directed effect systems whilst simplifying the design of the conventional self-directing systems, avoiding in particular the use of gyro equipment and the necessity of actively stabilizing a missile in attitude. A further object of the present invention is to extend the target-detecting field, i.e. the radius of action of the detection systems and to reduce the period needed to acquire information relative to the target and as a result to increase the duration of the guidance phase, and so the manoeuverability.

These objects are reached with a simplified autonomous guidance system for a missile of the shell or rocket type, which is not actively stabilized against rolling, comprising target detection means associated with the missiles; an accelerometric device mounted directly on the structure of the missile and including at least an accelerometer with sensing axis radial with respect to the missile axis for detecting the lateral acceleration of the missile; and means for elaborating a guiding force $F_p$ applied to the missile via actuators acting on rudders, characterized in that it further comprises passive means for keeping up the rolling movement of the missile; means associated with the accelerometric device for discriminating the lateral acceleration of the missile $\gamma_{ext}$ due to the outside forces and the centrifugal acceleration $\gamma_c$ due to rolling; means for determining serviceable values in relation to the vector $\vec{V}$ representing the relative speed of the missile with respect to the air in a reference system related to the missile from information supplied by the accelerometric device and by the associated discrimination means; in that the target detection means are directly mounted on the missile structure; in that it further comprises means to determine the serviceable values related to the vector $\vec{u_c}$ which represents the direction of the target with respect to the axis of the missile, from the target detection means and in that the means for elaborating a guiding force $\vec{F_p}$ elaborate the said force from the said pre-determined serviceable values related to the vectors $\vec{V}$ and $\vec{u_c}$.

With such a system, all the detection means can be mounted on the missile structure and there is no need for any gyro equipment. The missile does not either need to be stabilized in rolling position since the accelerometric device permits to determine the relative rolling position of the missile with respect to the direction of the target and to the direction of the speed vector. On the contrary, it suffices to have means for keeping up the rolling such as for example by a tail unit setting.

In the particular case where the accelerometric device only comprises one accelerometer, the discrimination means associated with the accelerometric device comprises a circuit for determining the mean value of the signal applied by the said accelerometer and a circuit for measuring the peak-to-peak amplitude of the said signal supplied by said accelerometer to give respectively a signal indicative of the missile centrifugal acceleration $\gamma_c$ and a signal indicative of the missile lateral acceleration $\gamma_{ext}$ due to outside forces.

However, according to an advantageous embodiment, the accelerometric device comprises at least two accelerometers, with radial sensing axis, placed at 90° from each other inside a plane perpendicular to the axis of the missile.

In this case, the accelerometric device comprises at least two accelerometers with radial sensing axis placed at 90° from each other inside a plane perpendicular to the axis of the missile.

According to a specific embodiment, the discriminator means associated with the accelerometric device can comprise a summing circuit for adding up the signals supplied by the said accelerometers and a substracting circuit for the signals supplied by the said accelerometers to produce respectively a signal indicative of the missile centrifugal acceleration $\gamma_c$ and a signal indicative of the missile lateral acceleration $\gamma_{ext}$ due to outside forces.

Generally speaking, the means to determine the serviceable values related to the vector $\vec{V}$ comprise square root extracting means to determine the rolling speed $\omega$ of the missile from the centrifugal acceleration $\gamma_c$ supplied by the discriminator means, circuits for detecting extrema of the lateral acceleration $\gamma_{ext}$ supplied by the discriminator means, rolling speed $\omega$ integration means controlled by the extrema detection circuits to give a signal indicative of the rolling angle j between the projection of the vector $\vec{V}$ on a plane perpendicular to the axis of the missile and a reference axis of the said plane tied to the missile, means for supplying a signal of approximation of the lift force $F\beta$ of the actuators from the steering angle $\beta$ supplied by a steering indicator, means to determine the component $F\beta \cos j$ of the approximated lift force $F\beta$ in the plane of incidence, from signals supplied by the approximation means of the lift force $F\beta$ of the actuators and the said integration means, means for elaborating the total force F tied to the acceleration $\gamma_{ext}$, means for substracting the component $F\beta \cos j$ with respect to the total force F to determine the force P due to the lift of the missile and means for restoring the value i of the angular position of the vector $\vec{V}$ from the force P.

The target detection means can comprise an optical system associated with at least a bar comprising a plurality of infra-red detectors which are aligned and form a predetermined angle $\theta$ with respect to the axis of the missile and the means to determine the serviceable values related to the vector $\vec{u_c}$ indicative of the missile-target direction comprise at least a circuit for determining the angle $\delta$ between the said vector $\vec{u_c}$ and the axis of the missile, from the identification of the excited detectors, and means for integrating the rolling speed $\omega$ supplied by square root extracting means, from the centrifugal acceleration $\gamma_c$, to give a signal indicative of a relative rolling angle $\phi$ between a detection plane defined by the vector $u_c$ and the axis of the missile and an axial reference plane tied to the missile.

It is to be noted that, for this type of simplified detection to be possible, it is only necessary for the missile to have a rolling movement, whilst the rolling speed can be variable.

According to a variant embodiment, the target detection means comprise an electronic scanning system of the target detection field.

According to an embodiment of the invention, the guiding force $\vec{F_p}$ elaboration means are worked out so that the speed $\vec{V}$ is caused to depend on the direction of the target $u_c$, from the predetermined serviceable values giving the values of the direction of the speed V, and of the direction of the target $\vec{u_c}$, from indications supplied by the accelerometric device and the means for detecting the target and the recorded information relative to the module of the speed $\vec{V}$ and to the aerodynamical parameters permitting to restore the incidence from the lift.

Figure 2:
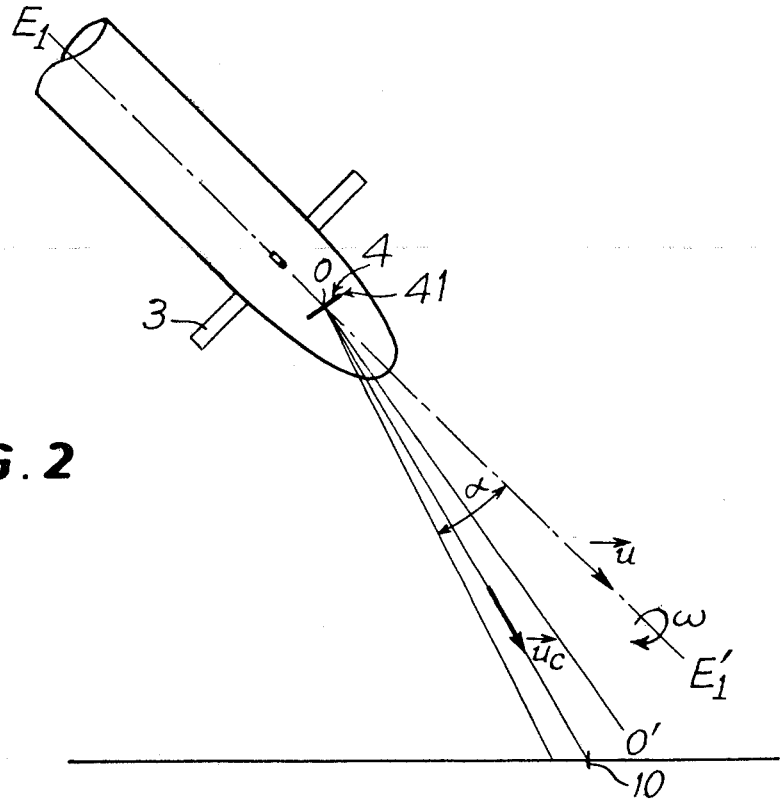
Figure 3:
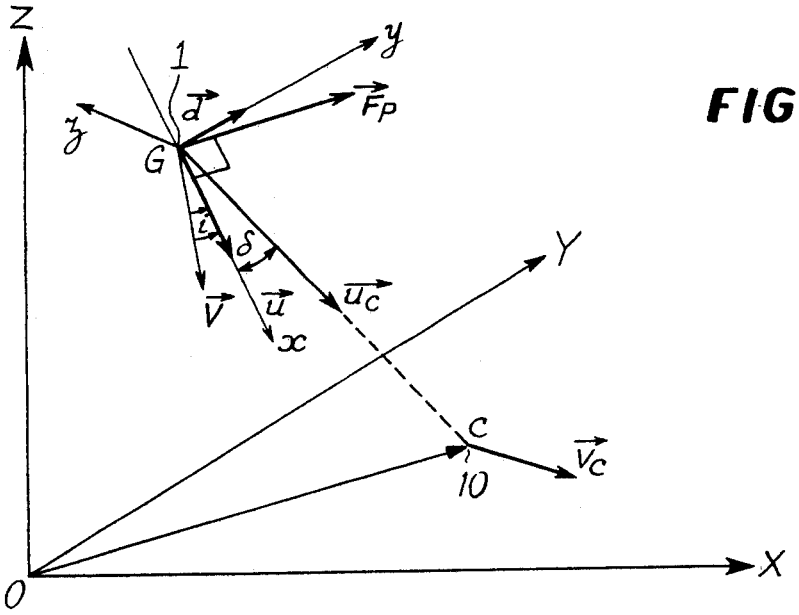
Figure 11:
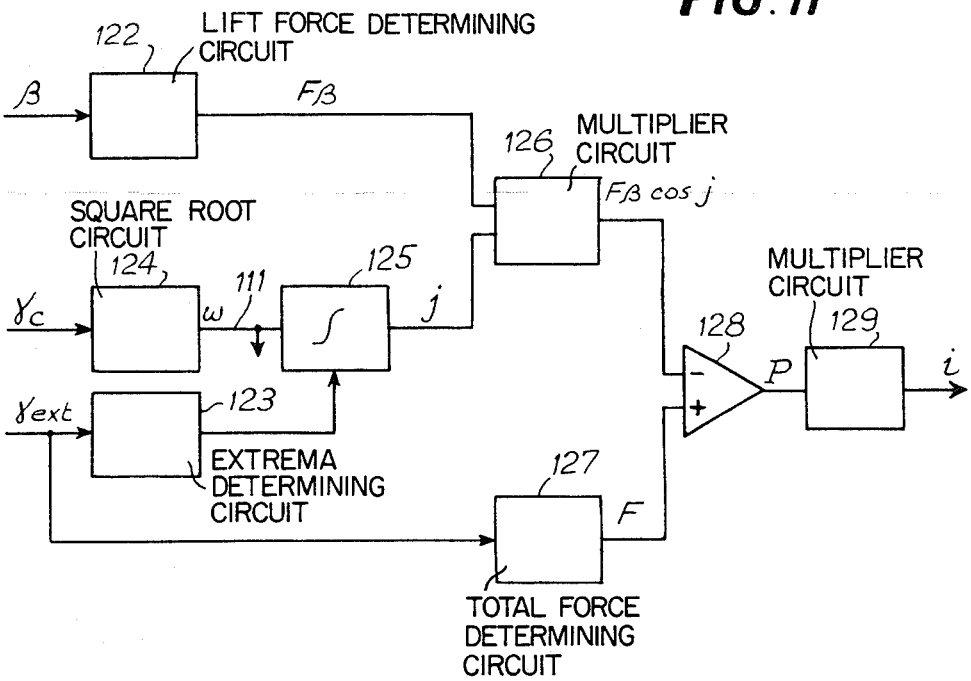

The invention will be more readily understood on reading the following description with reference to the accompanying drawings in which:

FIG. 1 is a diagrammatical perspective of a homing missile according to the invention, FIGS. 2 and 3 are diagrammatical views showing the principle of the detection of a target and of the guidance of the missile, FIG. 4 is a view of a block-diagram showing the different elements constituting the homing system according to the invention, FIG. 5 is a diagrammatical front elevational view of the accelerometric device illustrated in FIG. 1, FIGS. 6 and 7 show an example of target detectors used in the system according to the invention, FIGS. 8 and 9 are diagrammatical views of two examples of discrimination circuits associated to the accelerometric device of FIG. 5, FIG. 10 is a diagram showing the signals in different points of the circuits of FIGS. 8 and 9, and FIGS. 11 and 12 are more detailed diagrams of subassemblies of the circuits of FIG. 4.

The invention is more particularly applied to a missile of the shell or rocket type, such as the warhead 1 shown in FIG. 1. Such a warhead, generally designed to be launched by means of a self-propelled missile stabilized on a predetermined flight path is separated from the conveying vector at a certain altitude above the target detection field. According to the present invention, simplified homing means are incorporated to the warhead to allow it to reach the target with sufficient accuracy whilst avoiding the use of any of the expensive conventional systems of the self-directing type.

The head 1 can comprise a body 11 in which is stored a load of ammunitions designed to be dropped on a target, and a nose cone 12 equipped with a homing system for guiding the whole unit in the direction of the target. A tail unit or fins 2, spread out at dropping time, conventionally ensure a stabilization of the missile movement whereas rudders 3 controlled by the guiding system permit to direct the missile on the target when the target detection 4 and homing systems have started operating at a predetermined altitude above the target detection field. It should be noted that the target detection and homing systems according to the invention which can be operated at a relatively high altitude, for example 1000 m above the target detection field, are capable of giving instant indications of correction permitting an accurate guidance and to continue to operate down to a very low altitude immediately before the opening of the head and the dropping of all the subcharges contained in the body 11 of the missile.

At the beginning of the target detection and missile homing phase said missile has a rolling movement which can be aerodynamically kept up, of speed $\omega$ about its rolling axis $E_1 E'_1$ (FIGS. 1 and 2). The relative speed vector $\vec{V}$ of the missile with respect to the air, applied to the centre of gravity G of the missile forms an angle of incidence i with respect to the axis $E_1 E'_1$ of the missile. The unit vector $u_c$ which indicates the direction of the target 10 with respect to the missile 1 forms an angle $\delta$ with the rolling axis $E_1 E'_1$ of the missile (of unit vector $\vec{u}$) and the plane of the detected target 10 defined by the rolling axis $E_1 E'_1$ and the vector $u_c$. The rolling angle $\phi$ between the plane of the detected target $\vec{u_c}$, $\vec{u}$ and a reference plane $E_1 E'_1$, $E_3 E'_3$ tied to the structure of the missile is indicated in FIG. 1.

The guiding principle of the missile 1 with respect to the target 10 is illustrated by the vectorial diagram shown in FIG. 3. The detected target 10 has a moving speed $\vec{V_c}$ in a fixed reference system of the space OXYZ. The missile 1 of centre of gravity G to which is linked a reference system Gxyz such as the reference system $E_1$, $E_2$ $E_3$ of FIG. 1, has a relative moving speed $\vec{V}$ forming an angle of incidence i with the axis of the missile Gx (vector u). The vector $\vec{u_c}$ indicating the direction missile 1-target 10 forms an angle $\delta$ with the axis of the missile 1. The guiding force of the missile $\vec{F_p}$ is elaborated so as to cause the speed vector $\vec{V}$ of the missile to depend of the vector $\vec{u_c}$ giving the direction missile-target and is both, situated in the plane $(\vec{V}, \vec{u_c})$, perpendicular to the axis $\vec{u}$ of the missile and proportional to the angle $(\vec{V}, \vec{u_c})$. The guiding force $\vec{F_p}$ is applied to the missile by means of actuators 140 causing the steering of the rudders of the missile 150 (FIG. 4). The guiding force is itself elaborated continuously by a calculator 130 from information constituted by, on the one hand, the detection plane defined by the vectors $\vec{u_c}$, $\vec{u}$, and the angle $\delta$ and, on the other hand, the plane of incidence defined by the vectors $\vec{V}$, $\vec{u}$, and the angle of incidence i.

The data relative to the plane of incidence and to the angle of incidence i are applied to the calculating means 130 starting from calculating means 120 using the acceleration measuring information 121 supplied by the accelerometric device 5 attached to the missile 1 (FIG. 1) and the associated discriminator circuits 6. The information relative to the detection plane and to the angle $\delta$ are also applied to the calculating means 130 from calculating means 110 which use the information of rolling speed 111 also derived from the accelerometric device 5, and the target speed and position data 112 supplied by the detection device 4.

The detection and measuring devices supplying the aforesaid primary information to the guiding calculator 110, 120, 130 which deducts the serviceable values and elaborates the guiding force, will be described in more detail hereinafter.

The measuring members 5 and the detection member 4, supplying the primary information necessary to achieve the homing of the missile 1 in the direction of the target 10 are essentially characterized by a great simplicity of design since they are mounted on the missile structure itself and require no inertial support or gyro-type device.

The accelerometric device 5 (FIGS. 1 and 5) comprises at least an accelerometer 51 of radial sensing axis, i.e. perpendicular to the axis $E_1 E'_1$ of the missile 1. It is however possible to associate several accelerometers with radial sensing axes inside a plane perpendicular to the axis of the missile, preferably in the vicinity of the centre of gravity thereof. According to an advantageous embodiment, two accelerometers can be placed at 180° (references 51, 52) or at 90° (references 51, 53) from each other in fixed positions of a reference system $A_1 A'_1$, $A_2 A'_2$ attached to the missile structure. Such an accelerometric device gives primary information from which it is possible to determine the lateral acceleration $\gamma_{ext}$ due to the outside forces and therefore to know the lift P and to deduce therefrom the incidence i. To determine the plane of incidence and the angle of incidence i, one needs of course to substract the charge factor $F\beta$ due to the actuators, whose condition is known at any time from the steering angle $\beta$ and to know at least approximately the module of the speed $\vec{V}$ and of all the aerodynamical parameters permitting to restore the incidence from the lift. These values which are hardly fluctuating for a specific application can be either stored in constant form in the calculator 120 or introduced into said calculator before firing to take into account the parameters specific to said firing.

The accelerometric device 5 designed to allow the determination of the incidence i, i.e. of the orientation of the vector $\vec{V}$, has a second function permitting to use simplified target detection devices. Indeed, the accelerometers 51, 52 with radial sensing axes, furnish indications which permit to extract the centrifugal acceleration $\gamma_c$ due to rolling, whose value hardly varies at each rotation whereas the acceleration $\gamma_{ext}$ is due to the action of the lift, which action produces a sinusoidal signal. So that, from the rolling speed, it is possible to deduce simply and with the help of an integrator, the rolling position of the missile at any time, i.e. the relative rolling angle $\phi$ between the plane of the detected target containing the rolling axis $\vec{u}$ and the direction of the target $\vec{u_c}$ and a reference plane $E_2 E'_2$, $E_3 E'_3$. Knowing the rolling angle $\phi$ at any time, it is possible to use a target detection system 4 which only gives a complete information of the angular position of the target with respect to the axes of the reference system attached to the missile, a limited number of times per rolling period whereas the guiding force can always be applied at any time in a well determined plane, whatever the rolling position of the missile.

FIGS. 8 to 10 show how it is possible to determine, from the signals supplied by the accelerometric device 5, signals respectively indicative of the centrifugal acceleration $\gamma_c$ due to rolling and of the lateral acceleration $\gamma_{ext}$ due to outside forces.

In the case shown in FIG. 8, only one accelerometer 51 can be used to supply a signal $\gamma_1$ indicative of the total lateral acceleration to which the missile is subjected. The signal $\gamma_1$ is then applied, in a discriminator circuit 6, on the one hand to a circuit 61 which gives the mean value $\gamma_c$ of the signal $\gamma_1$ (FIG. 10), on the other hand to a circuit 62 for measuring the peak-to-peak amplitude of the signal $\gamma_1$ which circuit permits to determine at any time the value of the lateral acceleration $\gamma_{ext}$, since the signal originated by the circuit 62 corresponds then to a 2 $\gamma_{ext}$.

In the case illustrated in FIG. 9, two accelerometers 51 and 52 with radial sensing axes, placed at 180° from each other in a plane perpendicular to the axis of the missile (FIG. 5) give respectively signals $\gamma_1$ and $\gamma_2$ (FIG. 10) which are applied to the discriminator circuit 6, which circuit in this case comprises a summing circuit 63 and a substracting circuit 64 each one receiving the signals $\gamma_1$ and $\gamma_2$. As can be seen in the graph shown in FIG. 10, the summing circuit 63 delivers in output a signal 2 $\gamma_c$ proportional to the centrifugal acceleration due to rolling whereas the substracting circuit 64 delivers a signal indicative of the acceleration $\gamma_{ext}$ due to outside forces.

The signals $\gamma_c$ and $\gamma_{ext}$ delivered by the discriminator means 6 can then be used in combination with the signals supplied by the target detection device 4, to allow the elaboration of the guiding force $\vec{F_p}$ in the calculating units 110, 120, 130.

The target detection assembly 4 mounted on the head 1 can comprise an infra-red or visible imagery system with electronic scanning of the whole detection field permitting to obtain a precise information of angular position with a high recurrent frequency, or else microwave detection systems or laser-illuminated target detection systems. However a particularly advantageous detection unit 4 is constituted by an optical system 45 (FIG. 7) associated with to one or more bars 41, 42 (FIGS. 6 and 7) of infra-red detectors 40 aligned substantially radially with respect to the axis of the missile $E_1 E'_1$ and integral with the missile structure.

With this particular type of bar detectors, the scanning of the ground is simply obtained by a rolling movement of the missile, kept up for example aerodynamically. In this case the precise information of angular position of the target with respect to the axes of the reference system attached to the missile is only given n times per rolling period, n being the number of radial strips 41, 42 distributed around the axis of the missile. Each strip can comprise for example about thirty detectors IR of conventional type, cooled (for example in Cd Hg Te or Pb Sn Te) covering a total field about the optical axis 00′ of the optical system 45 attached to the detection bar. With a single bar, the target can be detected rapidly in one rolling rotation, and then repeated periodically at each rotation whilst permitting a permanent adjustment of the guiding force $\vec{F_p}$.

The system according to the invention thus permits to conduct, with measuring devices which are purely static with respect to the missile inside which they are mounted, an extensive, rapid and prolonged search for a target and to guide simply the missile towards that target.

By way of example, it is possible to use detectors with an elementary field of about 10 mrd×10 mrd. A bar 41 of detectors can for example be inclined so as to form an angle $\theta$ which can vary between about 60° and 90° with the axis $E_1 E'_1$ of the missile, and preferably between about 75° and 90°.

The detection and measuring system according to the invention which permits to know, on the one hand, the parameters relative to the relative speed $\vec{V}$ of the missile with respect to the air, due to an accelerometric measurement from which originates the measurement of the incidence i taken with the subassembly 120, and on the other hand, the parameters relative to the vector $\vec{u_c}$ giving the direction missile-target, for detectors, for example of the bar type, with the help of the sub-assembly 110, the guiding force $\vec{F_p}$ can be calculated in modulus and direction at each detection for example by the following formula:

$$\vec{F_p}=K(p)A\vec{F_{up}}$$

wherein: $\vec{F_{up}}$ is the component of the vector $\vec{F_u}$ which is normal to the axis $E_1 E'_1$ of the missile, the vector $\vec{F_u}$ being itself perpendicular to the missile speed $\vec{V}$, situated in the missile speed plane $\vec{V}$-direction missile-target $u_c$, oriented from $\vec{V}$ towards $\vec{u_c}$ and of modulus equal to $\sin \eta \simeq \eta$, wherein $\eta$ is the angle $\vec{V}$, $\vec{u_c}$.

Thus, in vectorial manner, if $\vec{V_1}$ is the unit vector of $\vec{V}$, the following formulas are obtained:

$$\vec{Fu}=(\vec{V_1} \wedge \vec{u_c}) \quad \vec{V_1}$$

$$Fup=Fu-(Fu \cdot u)u$$

The vector Fup is elaborated by the calculator 130 from data relative to $\vec{V_1}$ and $\vec{u_c}$ available on board the missile and supplied by the sub-assemblies 110, 120.

A is a known constant, calculated from data recorded before the departure of the missile and which is expressed by:

$$A=\tfrac{1}{2}\rho S V_o 2C'_{ZE}$$

wherein:

$\rho$ is the specific density of air

S is a reference surface $V_o$ is the modulus of the missile relative speed in relation to air.

$C'_{ZE}$ is a lift coefficient of the rudders 3.

K(p) is a correction operator taking into account the dynamic characteristics of the missile and of the activators such as the servo-motors controlling the steering of the rudders.

K (p) is thus a filter which can for example take the following form:

$$K(p) = k\frac{1 + 2\zeta\frac{p}{\omega_1} + \frac{p}{\omega_1}2}{1 + \frac{p}{\omega_2}2}$$

wherein k is a gain.

The numerator is a filter of second order, comprising a feedback of speed (with a damping coefficient $\zeta$) and of acceleration, The denominator is a frequency filter, p is the Laplace operator and the values of K, $\zeta$; $\omega_1$ and $\omega_2$ are dependent on special characteristics of the missile.

Also, when referring back to FIGS. 4, 11 and 12, there is shown an example of circuits permitting to elaborate the values used by the calculator 130 to determine the guiding force.

The means 120 to determine the serviceable values related to the vector $\vec{V}$, i.e. essentially the angle of incidence i, comprise (FIG. 11) a square root extracting circuit 124 to which is applied the signal $\gamma_c$ issued by the discriminator 6, to give a signal $\omega$ representing the rolling speed of the missile, a circuit 123 for detecting the extrema of the lateral acceleration $\gamma_{ext}$ permitting to give an indication of the moments when the accelerometers 51 or 52 related to the missile 1 are in the plane of incidence defined by the vectors $\vec{V}$ and $\vec{u}$, an integrator circuit 125 to which is applied the signal $\omega$ supplied by the circuit 124, and whose starting points of integration are controlled by the extrema detecting circuit 123, in order to deliver in output signals indicating the rolling angle j between the projection of the vector $\vec{V}$ on the plane perpendicular to the axis $E_1 E'_1$ of the missile and containing the accelerometers 51, 52 and a reference axis related to the missile in the said plane containing the accelerometers 51, 52. The angle j thus represents the angle between the said plane of incidence $(\vec{V}, \vec{u})$ and the said reference axis perpendicular to the axis $E_1E'_1$.

The circuit 120 further comprises a circuit 122 which delivers a signal representing the approximate value of the lift force $F\beta$ of the actuators 140, 150 from the value of the steering angle supplied by a steering indicator, not shown. A circuit 126 to which are applied the signals issued from the circuit 122 and from the integrator 125 permits then to have the value $F\beta \cos j$ of the component in the plane of incidence $\vec{V}$, $\vec{u}$, of the approximate lift force $F\beta$. The total force F related to the acceleration $\gamma_{ext}$ supplied by the discriminator circuit 6 is determined in the circuit 127 and applied to a substracting circuit 128 receiving also the signal originating from the circuit 126 in order to deliver in output a signal representing the force P due to the lift of the missile and which is equal to the total force F reduced by the component $F\beta \cos j$ which takes into account the charge factor due to the actuators and which is dependent both on their condition (angle $\beta$) and on the rolling position (angle j). The value of angle of incidence i of the vector $\vec{V}$, which is related to the force P by a simple coefficient of proportionality can then be supplied by the circuit 129 placed in output of the substractor 128.

Figure 12:
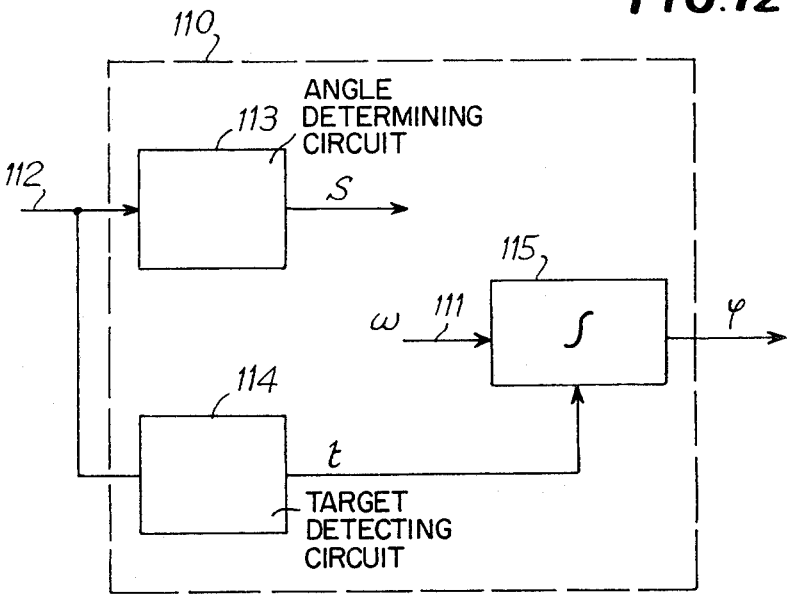

FIG. 12 shows the simplified diagram of means 110 to determine the serviceable values related to the vector $\vec{u_c}$ giving the direction missile-target. From the signals 112 supplied by the target detection device 4 and comprising the activated element or elements of detection 40, a circuit 113 supplies the value of the angle $\delta$ between the vectors $\vec{u_c}$ and $\vec{u}$. The aforementioned rolling angle $\phi$ between the projection of the vector $\vec{u}$ in the reference plane $E_2 E'_2$, $E_3 E'_3$ and the reference axis $E_3 E'_3$ related to the missile, and itself being determined by an integrator circuit 115 which receives a signal 111 indicative of the rolling speed $\omega$ which signal can be supplied for example by the circuit 124 of FIG. 11. The integrator circuit 115 is itself controlled by a circuit 114 which detects the moments when the targets passes into the detectors field and triggers the integration of the rolling speed $\omega$ from the said moments to give an indication of the angle $\phi$. Of course, various improvements or variants may be brought to the detection system. For example, it is possible, after the "finding" of a target, i.e. its detection by a detector element 47, to start reducing the field of vision of the detectors 40 around the said detector 47 i.e. to create a more reduced angular window by placing temporarily out of service those detector elements more remote from the said detector which has been excited. This enabling to keep a wide field of vision for the approach and the detection of a target, with a full bar in service, whilst reserving the possibility of increasing the signal/noise ratio by limiting the number of adjacent detectors in service when one target has already been detected. It is also possible, after a first detection of target by the detectors, to place temporarily out of service the detectors of one bar after each passage of the target in the detection field of the said bar. In the case of ground targets, the detectors for one bar are in effect operational only for a relatively small fraction of a rolling rotation. A test can thus be conducted, for example by the calculator 130 to time, at every rolling rotation, the return to service of the circuits associated to a bar of detectors which, after the recording of a detection were automatically inhibited.

Various modifications and additions may of course be made to the description given hereinabove of the invention, without departing from its scope or from its spirit.

We claim:

1. Simplified homing system for a missile of the shell or rocket type which is not actively stabilized against rolling, comprising means for detecting a target, which means are directly mounted on and associated with the missile; an accelerometric device mounted directly on the missile structure and including at least one accelerometer having a sensing axis radial with respect to the missile axis to detect the lateral acceleration of the missile; means for elaborating a guiding force $\vec{F_p}$ applied to the missile via actuators acting on rudders, said elaborating means including passive means for ensuring the keeping up of the rolling movement of the missile; means associated with the accelerometric device for discriminating the lateral acceleration $\gamma_{ext}$ of the missile due to outside forces and the centrifugal acceleration $\gamma_c$ due to the rolling; means for determining the serviceable values related to the vector $\vec{V}$ indicating the relative speed of the missile with respect to the air in a reference system related to the missile from information supplied by the accelerometric device and the associated discriminator means; and means for determining serviceable values related to the vector $\vec{u_c}$ representing the direction of the target with respect to the axis of the missile from target detection means, wherein the means for elaborating a guiding force $\vec{F_p}$ elaborates said force from the said predetermined serviceable values related to the vectors $\vec{V}$ and $\vec{u_c}$.

2. Missile homing system as claimed in claim 1, wherein the discriminator means associated with the accelerometric device comprise a circuit to determine the mean value of the signal supplied by the said accelerometer and a circuit for measuring the peak-to-peak amplitude of the said signal supplied by the said accelerometer to supply respectively a signal indicative of the centrifugal acceleration $\gamma_c$ of the missile and a signal indicative of the lateral acceleration $\gamma_{ext}$ of the missile due to outside forces.

3. Missile homing system as claimed in claim 1, wherein the acelerometric device comprises at least two accelerometers having radial sensing axes placed at 180° from each other in a plane perpendicular to the axis of the missile.

4. Missile homing system as claimed in claim 1, wherein the accelerometer device comprises at least two accelerometers having radial sensing axes placed at 90° from each other in a plane perpendicular to the axis of the missile.

5. Missile homing system as claimed in claim 3, wherein the discriminator means associated with the accelerometer device comprise a circuit summing up the signals supplied by the said accelerometers and a circuit for substracting the signals supplied by the said accelerometers to produce respectively a signal indicative of the centrifugal acceleration $\gamma_c$ of the missile and a signal indicative of the lateral acceleration of the missile $\gamma_{ext}$ due to outside forces.

6. Missile homing system as claimed in any one of claims 1 to 5, wherein the means to determine the serviceable values related to the vector $\vec{V}$ comprise square root extracting means to determine the rolling speed $\omega$ of the missile from the centrifugal acceleration $\gamma_c$ supplied by the discriminator means, circuits for detecting extrema of the lateral acceleration $\gamma_{ext}$ supplied by the discriminator means, means for integrating the rolling speed $\omega$ controlled by the extrema detection circuits to supply a signal indicative of the rolling angle j between the projection of the vector $\vec{V}$ on a plane perpendicular to the axis of the missile and a reference axis of the said plane related to the missile, means for supplying an approximation signal of the lift force $F\beta$ of the actuators from the steering angle $\beta$ given by a steering indicator, means to determine the component $F\beta \cos j$ of the approximate lift force $F\beta$ in the plane of incidence, from signals supplied by the approximation means of the lift force $F\beta$ of the actuators and the said integration means, means for elaborating the total force F related to the acceleration $\gamma_{ext}$, means for substracting the component $F\beta \cos j$ with respect to the total force F in order to determine the force P due to the lift of the missile and means for restoring the value i of the angular position of the vector $\vec{V}$ from the force P.

7. Missile homing system as claimed in any one of claims 1 to 5, wherein the target detection means comprise an optical system associated with at least one bar comprising a plurality of infrared detectors aligned and forming a predetermined angle $\theta$, with the axis of the missile and wherein the means to determine the serviceable values related to the vector $\vec{u_c}$ indicative of the direction missile-target comprise at least a circuit to determine the angle $\delta$ between the said vector $u_c$ and the axis of the missile from the identification of the excited detectors, and means for integrating the rolling speed $\omega$ given by the square root extracting means, from the centrifugal acceleration $\gamma_c$ to give a signal indicative of a rolling angle $\phi$, between a detection plane defined by the vector $\vec{u_c}$ and the axis of the missile and an axial reference plane related to the missile.

8. Missile homing system as claimed in claim 7, wherein the target detection means comprise at least one radial bar of infrared detectors forming a predetermined angle with the axis of the missile, which angle can vary between about 60° and 90°.

9. Missile homing system as claimed in any one of claims 1 to 5, wherein the target detection means comprise a system for electronically scanning the target detection field.

10. Missile homing system as claimed in any one of claims 1 to 5, wherein said system is applied to the guidance of a shell- or rocket type missile equipped with an assembly of non-guided sub-charges dropped at a small distance from the detected target.

11. Missile homing system as claimed in claim 6, wherein the target detection means comprises an optical system associated with at least one bar comprising a plurality of infrared detectors aligned and forming a predetermined angle $\theta$, with the axis of the missile and wherein the means to determine the serviceable values related to the vector $\vec{u_c}$ indicative of the direction missile-target comprise at least a circuit to determine the angle $\delta$ between the said vector $\vec{u_c}$ and the axis of the missile from the identification of the excited detectors, and means for integrating the rolling speed $\omega$ given by the square root extracting means, from the centrifugal acceleration $\gamma_c$ to give a signal indicative of a rolling angle $\phi$, between a detection plane defined by the vector $\vec{u_c}$ and the axis of the missile and an axial reference plane related to the missile.

12. Missile homing system as claimed in claim 11, wherein the target detection means comprise at least one radial bar of infrared detectors forming a predetermined angle with the axis of the missile, which angle can vary between about 60° and 90°.

13. Missile homing system as claimed in claim 6, wherein the target detection means comprise a system for electronically scanning the target detection field.

14. Missile homing systems as claimed in claim 6, wherein said system is applied to the guidance of a shell- or rocket type missile equipped with an assembly of non-guided sub-charges dropped at a small distance from the detected target.

15. Missile homing systems as claimed in claim 7, wherein said system is applied to the guidance of a shell- or rocket type missile equipped with an assembly of non-guided sub-charges dropped at a small distance from the detected target.

16. Missile homing systems as claimed in claim 8, wherein said system is applied to the guidance of a shell or rocket type missile equipped with an assembly of non-guided sub-charges dropped at a small distance from the detected target.

* * * * *